US006691859B2

(12) United States Patent
Weber

(10) Patent No.: US 6,691,859 B2
(45) Date of Patent: Feb. 17, 2004

(54) AUTOMATIC FEEDER FOR STRIP-SUPPORTED CONTACTS

(75) Inventor: Jerome L. Weber, Escondido, CA (US)

(73) Assignee: Autosplice Systems, Inc., San Diego, CA (US)

( * ) Notice: Subject to any disclaimer, the term of this patent is extended or adjusted under 35 U.S.C. 154(b) by 118 days.

(21) Appl. No.: 10/027,869

(22) Filed: Dec. 20, 2001

(65) Prior Publication Data

US 2003/0118429 A1 Jun. 26, 2003

(51) Int. Cl.[7] ..... B65B 69/00
(52) U.S. Cl. ..... 198/464.3; 221/74
(58) Field of Search ..... 198/464.3; 221/74; 156/584; 414/412; 225/2, 5, 96.5, 101; 83/929.1, 929.2, 914, 190

(56) References Cited

U.S. PATENT DOCUMENTS 4,872,258 A * 10/1989 Ragard ..... 29/740
5,605,430 A * 2/1997 Legrady ..... 414/412
6,507,997 B2 * 1/2003 Kawai et al. ..... 29/833

* cited by examiner

*Primary Examiner*—Thomas J. Brahan

(57) ABSTRACT

A novel feeder construction, and method of operation, that is easily interfaced to a variety of conventional pick-and-place machines and can readily and reliably feed components suspended from a carrier for pickup at a pickup location by the pick-and-place machine. In a preferred embodiment, the carrier with suspended components is fed in a line spaced laterally from the pickup location. The lead component when separated from the strip must then be moved laterally to the pickup location. By laterally spacing the carrier strip of components from the pickup location it is ensured that the feeder parts involved in separating the component from the carrier do not obstruct movement of the vacuum nozzle of the pick-and-place machine during the pickup operation and advancement of the carrier to present the next component.

27 Claims, 12 Drawing Sheets

AUTOMATIC FEEDER FOR STRIP-SUPPORTED CONTACTS

The invention is directed to an automatic feeder for strip-supported electrical components and its method of operation, and in particular for supplying discrete components from a supply of components supported from a continuous strip for pickup by any one of conventional pick-and-place machines.

BACKGROUND OF INVENTION

Pick-and-place machines are well known and widely used in the populating of printed circuit boards or cards (PCBs) by components using surface mount technology (SMT). They offer the capability of precision in component placement, and speed in picking up a component from its source and placing it typically on a solder-paste covered pad on the PCB. Often the components are removed from small receptacles on a tape carrier. Nowadays, however, components are often supplied on a strip unreeled from a reel supplied to the PCB maker by the component supplier. U.S. Pat. No. 5,605,430 describes a feeder actuated by a pick-and-place machine for components connected to each other at their base to form a strip, which patent disclosure is hereby incorporated by reference. With this strip of components such as pins or posts, the beveled end of the pin or post which is adapted to be picked up the conventional vacuum nozzle of a standard pick-and-place machine, is positioned above its base and thus the beveled pickup end rises free of the base and free of adjacent components and when separated from its neighbor is ready for pickup. However, some suppliers supply components suspended by their beveled pickup end from a common carrier. In this case, the beveled pickup end is obstructed by the carrier. Moreover, even if the component can be separated from its carrier, the carrier may obstruct the vacuum nozzle when it arrives to pickup the separated component. The feeder described in U.S. Pat. No. 5,605,430 is incapable of feeding such a strip of components for automatic pickup by pick-and-place machines.

SUMMARY OF INVENTION

A principal object of the invention is an automatic feeder for components suspended from a common carrier for pickup by a conventional pick-and-place machine.

A further object of the invention is a low cost high speed automatic feeder compatible with various pick-and-place machines and easily capable of feeding various diameters and lengths of components such as pins or posts to the pick-and-place machine.

Still another object of the invention is a method of separating components from a strip of components and making them available for pickup by a conventional pick-and-place machine.

These objects are achieved in accordance with one aspect of the invention by a novel feeder construction that is easily interfaced to a variety of conventional pick-and-place machines and can readily and reliably feed components suspended from a common carrier after separation for pickup by the pick-and-place machine. In the context of this application, the term "suspended" when employed in relation to the carrier, means that the components are supported from above by the carrier, or the components hang from and below the carrier. In a preferred embodiment, the carrier with suspended components is fed along a path spaced laterally from the location where the component must be placed to be picked up by the descending pickup arm of the pick-and-place machine. The lead component when separated from the strip must then be moved laterally to the pickup location. By laterally spacing the carrier strip of components from the pickup location it is ensured that the feeder parts involved in separating the component from the carrier and carrying the separated component to the pickup location do not obstruct movement of the vacuum nozzle of the pick-and-place machine during the pickup operation nor advancement of the carrier to supply the next component.

In accordance with another feature of the invention, the feeder parts that separate the lead component from the carrier and move it to the pickup location comprise a component-retaining means having a clamping surface and means for temporarily holding the separated component against the clamping surface between the time that the component is separated and the time that it is ready for pickup. The timing of the feeder operation is controlled such that the holding means releases the component and the element forming the clamping surface is moved away from the pickup location before the pickup arm with the engaged component departs the pickup location.

In accordance with still another feature of the invention, the feeder parts are arranged such that the part that actually separates the lead component from the carrier accomplishes this by engaging the component near where it is connected to the carrier while simultaneously the part forming the clamping surface also engages a portion of the component further removed from its connection to the carrier to ensure a clean shearing without bending of the component from the carrier.

As still another feature of the invention, the component-separating means comprises means for straightening the components on the strip before they have reached the separation position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF PREFERRED EMBODIMENTS

Figure 11:
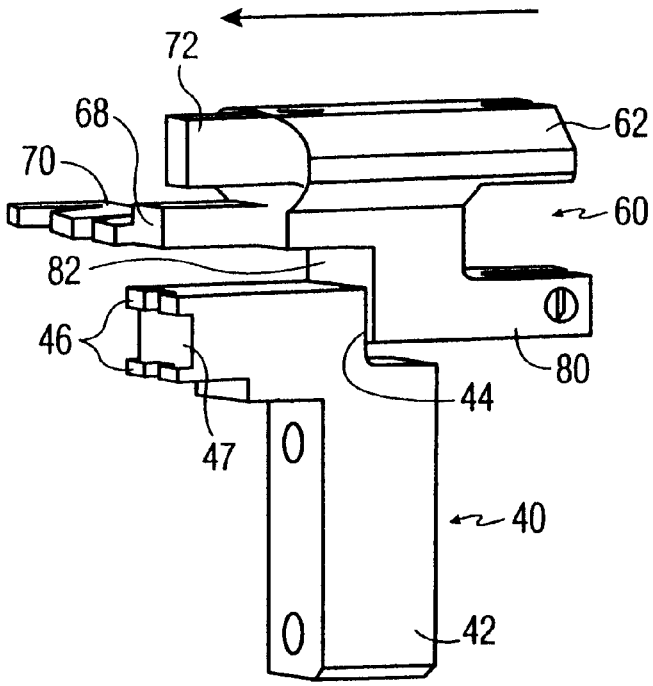
FIG. 11 is a perspective view of just the pin separating and part of the retaining mechanism.
Figure 12:
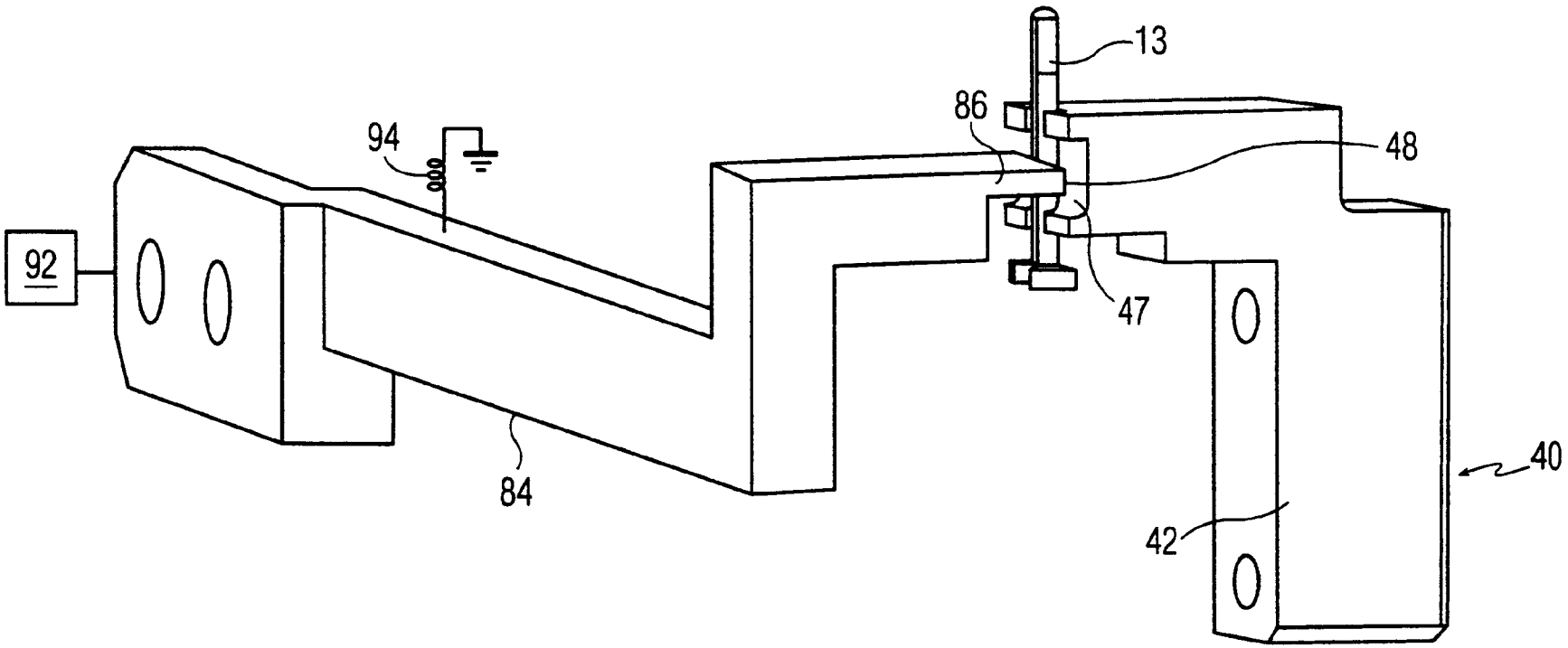
FIG. 12 is a perspective view from the front of just the component-separating and retaining mechanism.

The feeder of the invention is capable of handling components suspended from a common carrier. Pin examples are described and illustrated in U.S. Pat. No. 5,451,174, whose contents are hereby incorporated by reference. FIG. 12 of that patent illustrates a carrier strip 75 having a pin 80 attached. The carrier is shown positioned below the pin for those instances where the pin beveled end, when separated from the carrier, is to be inserted into a hole in a substrate. For SMT components, however, where the base is to be placed on a pad, as illustrated in FIG. 11, and the vacuum nozzle pickup member of the pick-and-place machine will engage the beveled pin end to pick it up, it is preferred that the carrier position is inverted so that the pins are suspended from the carrier positioned above them. It will be understood that the feeder of the invention can also be readily adapted to handle a wide variety of SMT components, and a wide variety of SMT pins and posts of different configurations, and thus the claims are not to be limited to the pins specifically illustrated in the '174 patent or used to illustrate the invention in the specific embodiment.

Figure 1:
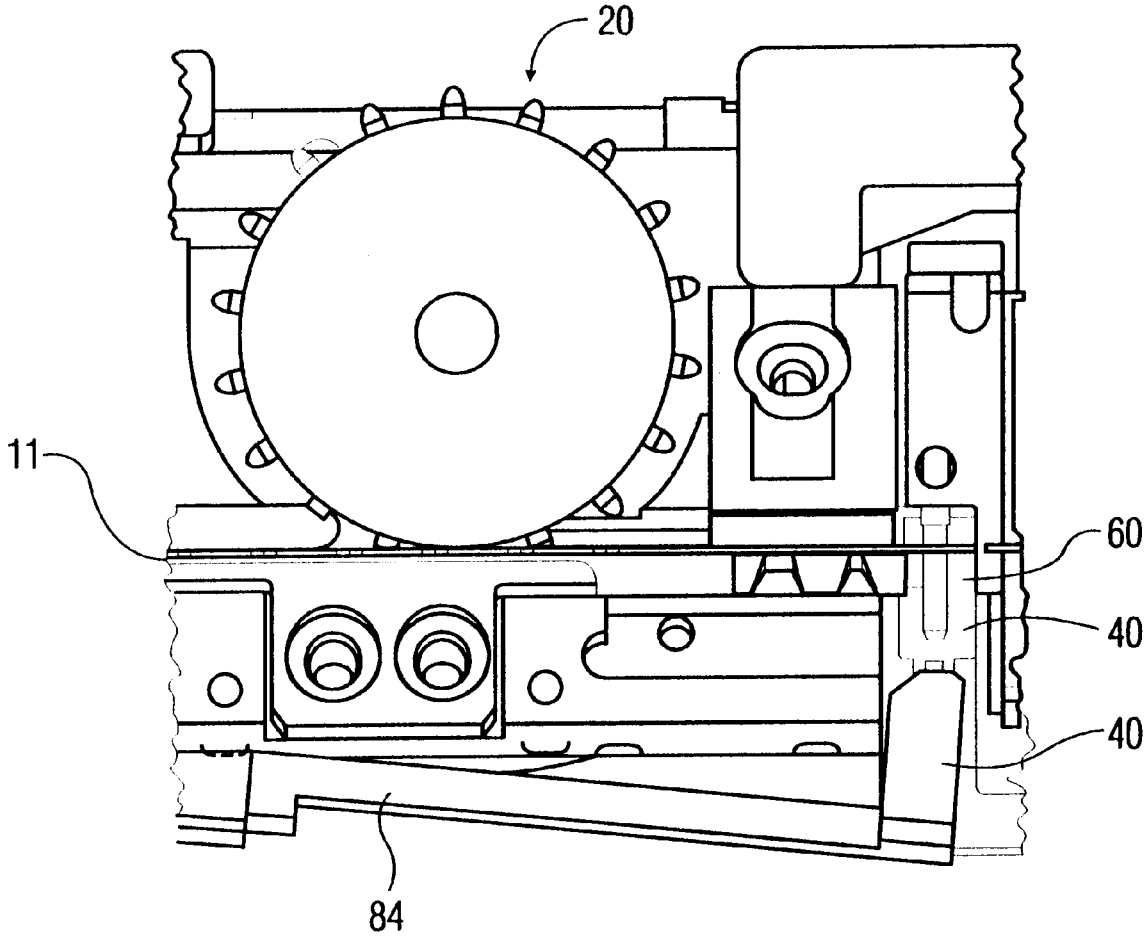
FIG. 1 is a partial simplified top view of part of one form of a feeder in accordance with the invention.

One form of the feeder according to the invention is illustrated in FIG. 1 is for SMT stamped pins and is a self-contained high-speed precision electropneumatic mechanical apparatus which presents discrete separated SMT pins from a strip of pins suspended by their beveled end from a common carrier to a pickup location for a vacuum nozzle of a surface-mount pick-and-place machine. The pins are integral with the carrier, are homogenous, and are stamped from a continuous strip of material appropriate for the specific application, typically copper or a copper alloy. Several forms of such pins are sold by the assignee under the trademarked names MiniFoot surface mount pins. The feeder always holds or clamps the separated pin in the pickup location until the pick-and-place machine retrieves the pin, after which the feeder presents the next following pin from the strip into the vacant pickup location. The separated pin retainer is preferably comprised of a small V-block forming a clamping surface facing the pickup location and which block moves in a horizontal direction laterally to the pin and the carrier, and a rotating spring-loaded retaining lever directly opposite the clamping surface of the V-block which lever tightly presses the pin against the V-block clamping surface. The pin retainer cooperates with a pin separator which is used to shear the pin from its carrier support while the separated pin is simultaneously clamped to the V-block by the retaining lever, both the pin retainer and the pin separator engage the lead pin from the remote side of the carrier to where they have been moved before the carrier is advanced to provide a fresh lead pin. The operation will become clearer from the description that follows.

Figure 6:
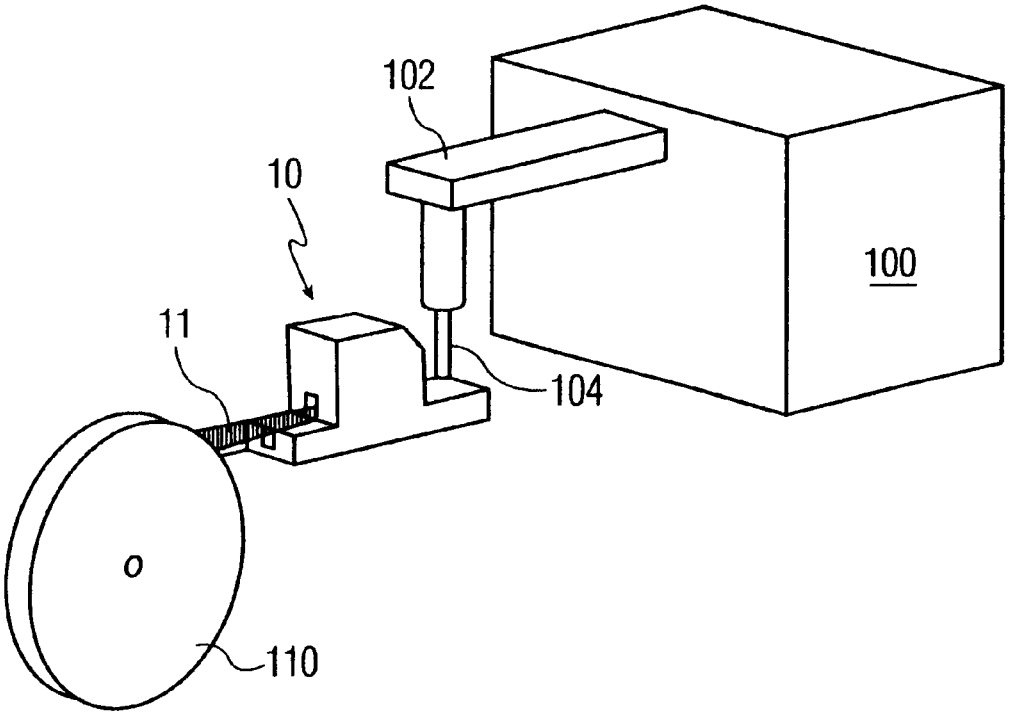
FIG. 6 illustrates schematically in simplified form the combination of the reel supplying a strip of components to a feeder adjacent a pick-and-place machine.

FIG. 6 is a schematic view illustrating a feeder 10 according to the invention positioned adjacent a pick-and-place machine 100 having a pickup arm 102 from which a vacuum-operated pickup nozzle 104 is suspended. In the operation of a conventional pick-and-place machine, under computer control, the arm 102 swings out from the machine, moves vertically downwards along a descending axis toward a component held in some fashion below the descending nozzle at a pickup location, engages and picks up by suction or other means the engaged component, and then returns to place the component on a computer-directed site on a PCB, after which a new cycle begins repeating the above steps. The function of the feeder 10 is to supply automatically a fresh component at the pickup location after the previous component has been picked up. The feeder of the invention is adapted for use with a variety of different pick-and-place machines supplied by different vendors. The machines typically have different operating cycles and thus, for maximum speed, it is desirable to be able to adjust the feeder operating cycle to be compatible with each of the different machines. In the feeder of the invention, this is readily obtained because, as will be explained in greater detail below, the feeder uses a micro-controller which can be programmed to control the timing of the sequence of steps that the feeder employs to carry out its functions. In addition, the feeder is not physically actuated by the pick-and-place machine nor is it connected to the normal feeder actuating mechanisms of the machine. The only connecting relationships are optical sensors in the feeder for detecting the arrival of the pickup arm and the positioning of the feeder such that the pickup location is aligned with the descending axis of the pickup nozzle.

Figure 2:
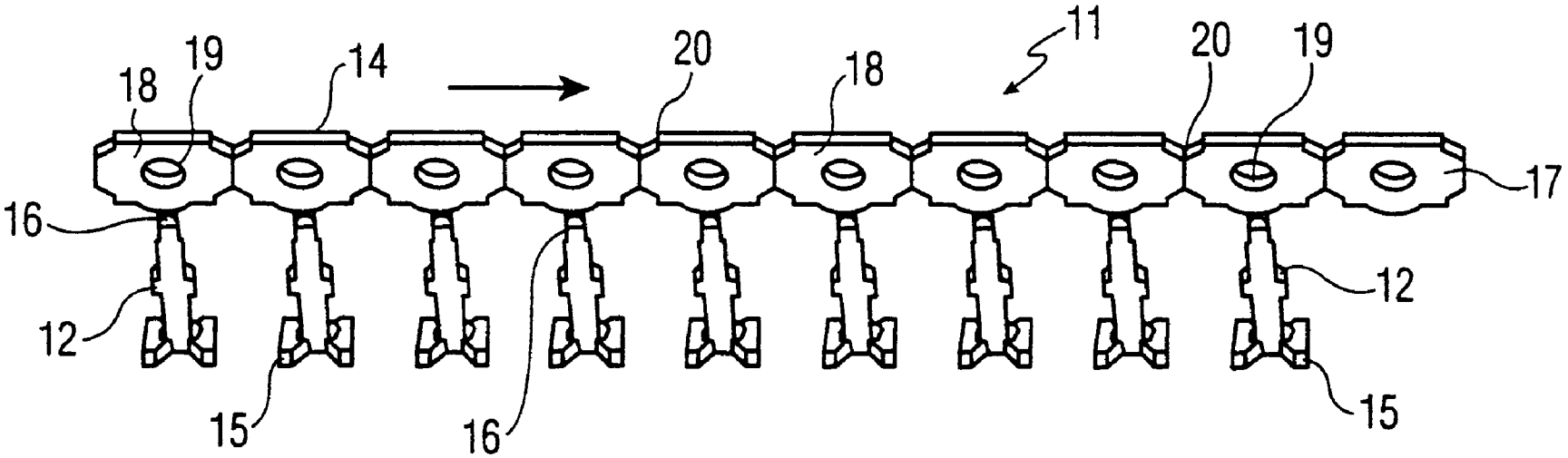
FIG. 2 is a partial perspective view of one form of a strip of suspended components that can be handled by the feeder in accordance with the invention.

The components are supplied in this case as a strip 11 from a reel 110 holding a supply of the components supported on a carrier. FIG. 2 illustrates a strip 11 of SMT pin-components 12 suspended from a common carrier 14 which are supplied from the reel 110 of FIG. 6. Each pin 12 comprises an elongated body having at its bottom a base 15 for surface mount on the PCB and having at its top where it is attached to the carrier a beveled end 16 (of reduced cross-section) which allows the pin to be readily separated from the carrier 14 by applying a pushing force transverse to the plane of the carrier. The carrier 14 is composed of connected segments 18, each with an indexing hole 19, connected to adjacent neighbors by a reduced cross-section link 20, which allows the segment 18 to be readily separated from the carrier 14 also by applying a pushing force transverse to the plane of the carrier. The vacuum nozzle 104 must pickup the pin by its beveled end 16 so that at the PCB it can be placed base-down 15 on the chosen site. Therefore, the pin 12 must be separated from the carrier 14 to free up its beveled end 16 before it can be picked up by the nozzle 104.

Figure 3:
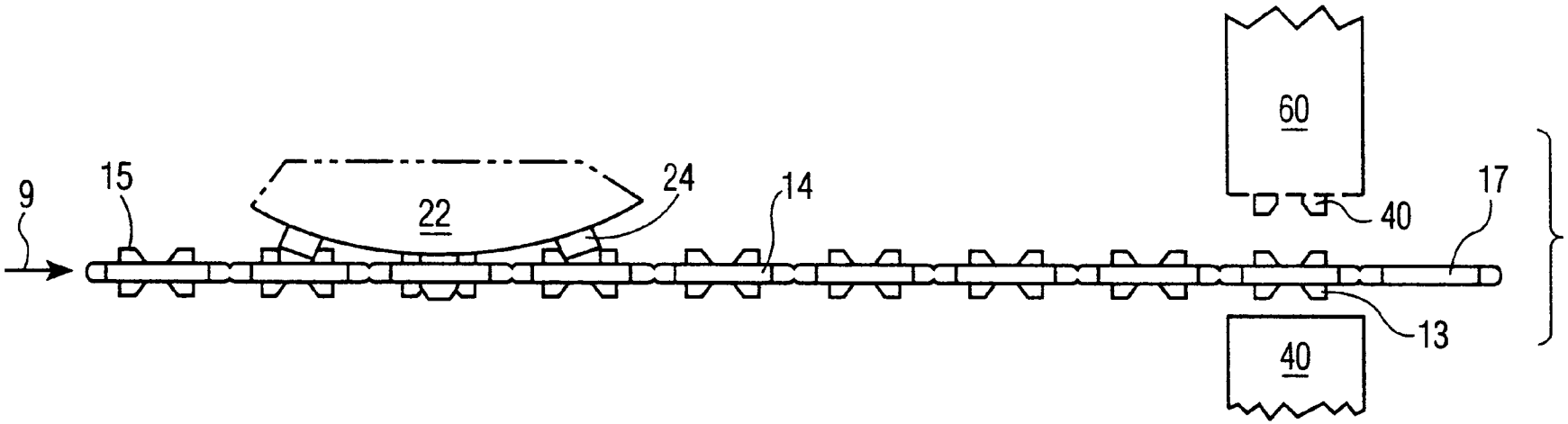
FIG. 3 is a top schematic view illustrating several principal elements of the feeder of FIG. 1 in their positions before separating a lead component from the strip.
Figure 4:
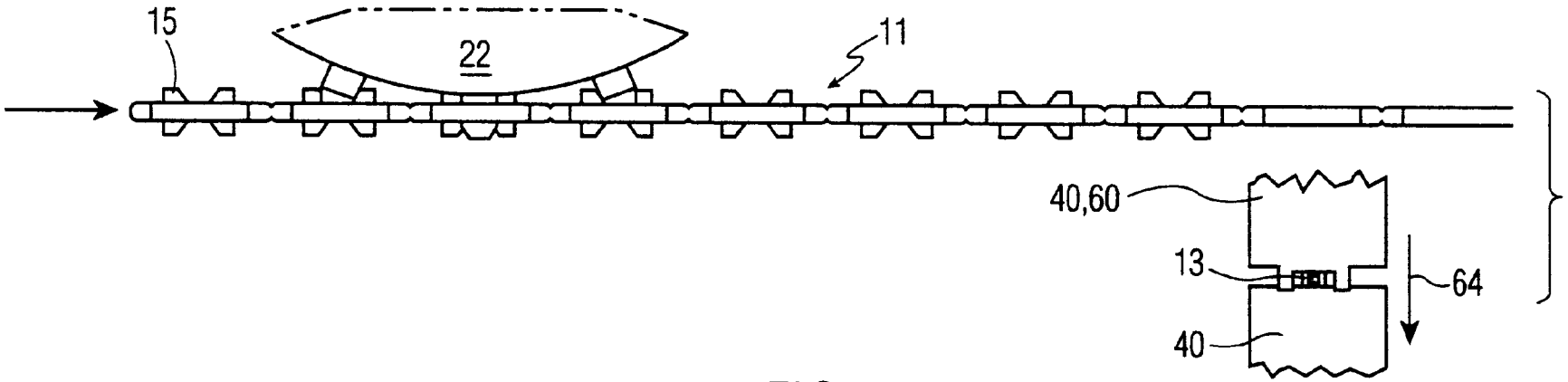
FIG. 4 is a top schematic view similar to FIG. 3 illustrating the same elements of the feeder of FIG. 1 when a separated component is waiting to be picked up.
Figure 5:
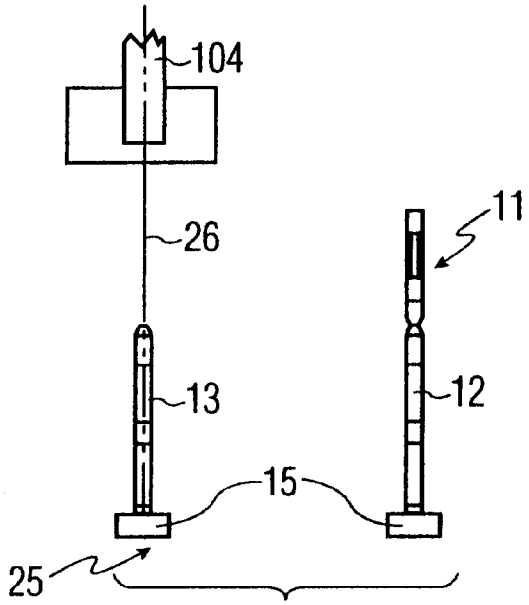
FIG. 5 is a partial simplified end view from the right of FIG. 3 illustrating the lateral separation of the carrier strip and pickup location.

FIG. 1 is a partial assembly view from the top of one form of feeder 10 according to the invention, which comprises a strip advancing means 20, a component-retaining means 40, and a component-separating means 60 mounted on a suitable support (not shown). FIGS. 3–5 illustrate the basic operations of the machine. The strip 11 is shown advancing step-by-step in the direction of the arrow 9 by an indexing wheel 22 with protuberances 24 engaging the holes 19 in the strip segments 18. The strip is advanced until the lead pin 13 reaches a position opposite the pin separator and retainer 40, 60 which have been positioned as shown on the far side of the strip. By "far side" is meant the side of the strip plane furthest from the pickup location; in FIG. 3, the side above the strip 11. By "near side" is meant the side of the strip plane nearest the pickup location; in FIG. 3, the side below the strip 11. When the strip reaches the position shown in FIG. 3, under control of the controller, the parts 40, 60 on the far side of the strip move laterally (downward in FIG. 3) toward the pickup location during which the separator 60 engages the lead pin simultaneously with the pin retainer 40 shearing the lead pin 13 from the carrier and also shearing from the strip the scrap segment 17 left over when the previous pin was separated from that segment. The parts continue moving as shown by the vertical arrow 64 in FIG. 4 toward the pickup location and are now, as shown in FIG. 4, on the near side of the strip with the captured lead pin 13 held by the pin retainer 40.

The lateral separation of the plane of the advancing strip 11 from the pickup location 25 is illustrated in the end view schematically shown in FIG. 5. As will be noted, the pickup location 25 is aligned with the descending axis 26 of the pickup nozzle 104.

Figure 7:
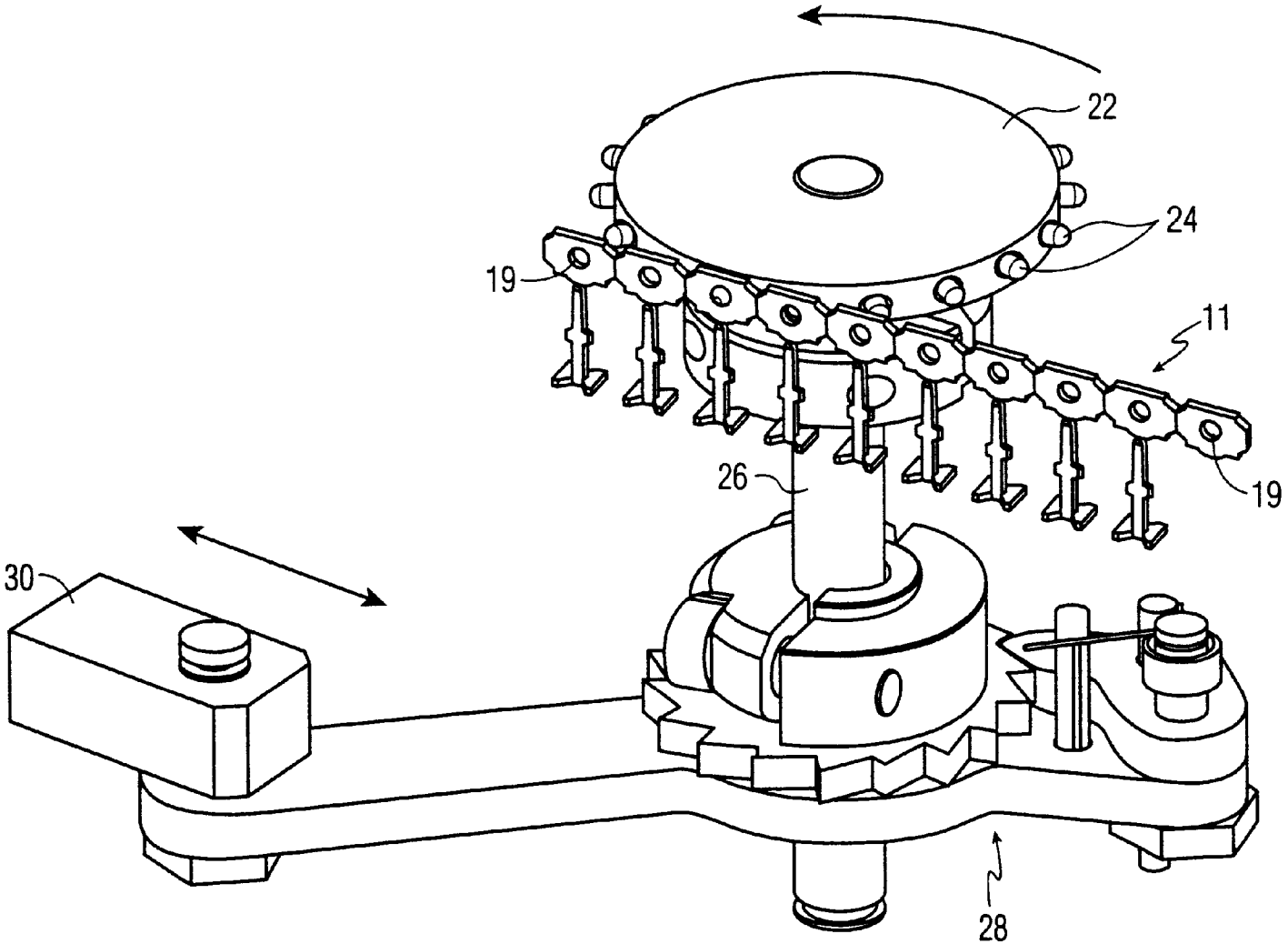
FIG. 7 illustrates schematically one form of indexing mechanism for advancing the component strip in a feeder in accordance with the invention.

FIG. 7 illustrates one form of advancing means suitable for use in the feeder of the invention. It uses mechanical and pneumatic means, but it will be understood that the required action can be achieved by other well known means such as electrical by any kind of timer or preferably under control of controller (not shown). The action required is simply to rotate a vertical drive shaft 26 under control of a mechanical linkage and ratcheting device 28 activated by the, stroke of a pneumatic cylinder (not shown) whose piston is connected to a small pivoting block 30 by means of a pin. Each time the lever 30 is moved to the right in FIG. 7, the vertical shaft 26 rotates CCW, which in turn rotates CCW the indexing wheel 22 mounted on top and thus the strip 11 is advanced to the right one pitch distance (the center-to-center spacing of the strip holes 19).

Figure 8:
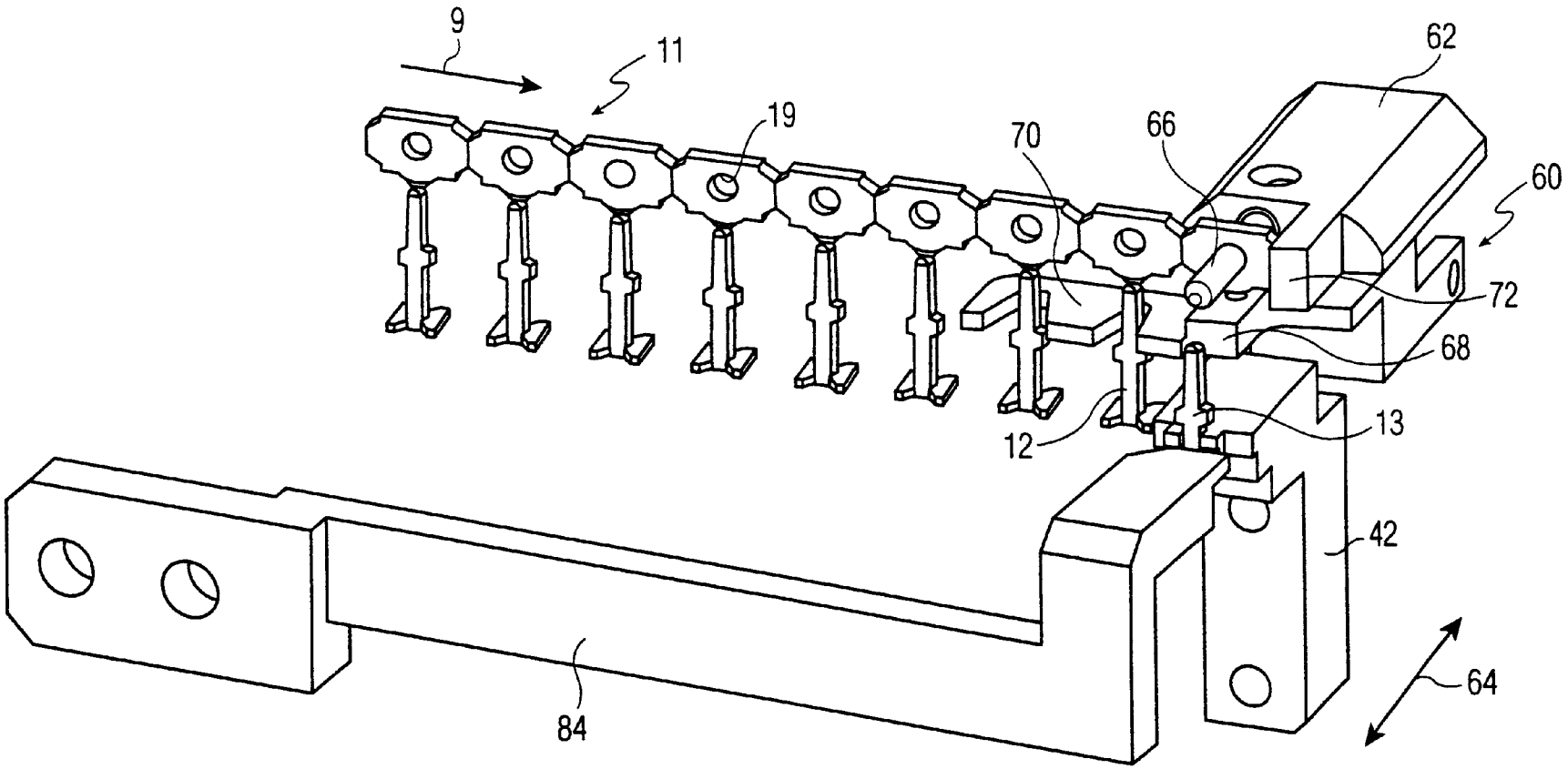
FIG. 8 illustrates schematically one form of component-separating mechanism for separating a component from the strip and the retaining mechanism for the separated component in a feeder in accordance with the invention.

FIG. 8 illustrates one form of the pin separator 60 and pin retainer 40 assembly of the invention. FIGS. 9–13 illustrate various details of the assembly. The pin separator 60 comprises a block 62 mounted in any suitable way for movement along a path 64 that preferably is transverse to the plane of the strip 11. The path 64 is shown by the vertical arrow in FIG. 4 and by the double-headed arrow in FIG. 8. The separator comprises a shaft aligner 66 that is sized and positioned to engage the indexing hole 19 in the segment 18 supporting the lead pin 13 in order to precisely align that carrier segment with the pin separator. The separator further comprises an upstream protrusion 68 positioned to engage the side of the lead pin, which includes an axially-extending upstream toothed member or comb 70 which also embraces the two upstream following pins 12 leaving however a gap at the rear between the back surface of the tooth and the pins to accommodate the lateral movement of the block 62 without the comb 70 contacting at its back surface the upstream following pins 12. This assists in maintaining the alignment of the strip pins with the pin separator. The separator further comprises a downstream protrusion 72 which functions to shear off the scrap segment 17 (not shown in this view) left over on the strip when the preceding pin was separated.

Figure 9:
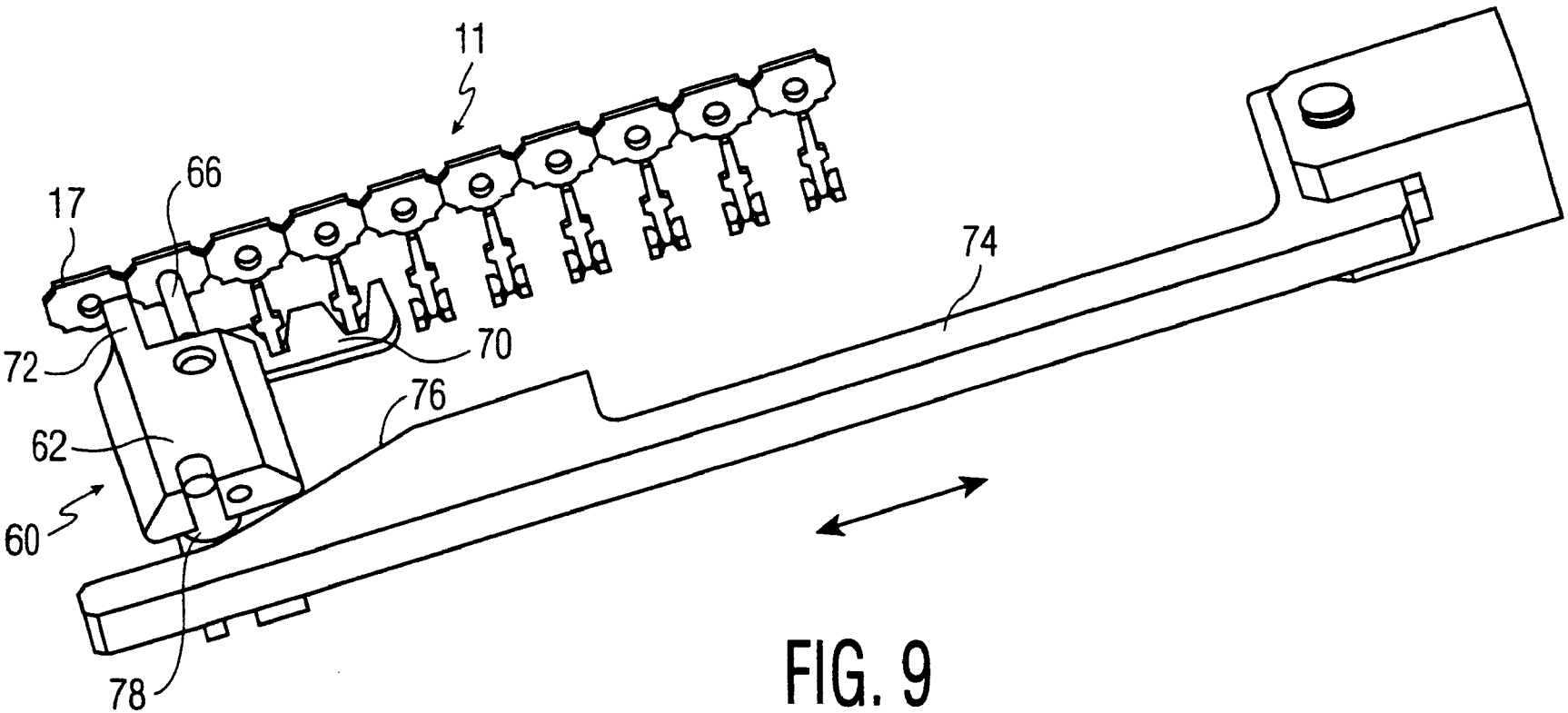
FIG. 9 is a perspective view from the rear of the mechanism of FIG. 8 but without the retaining mechanism.
Figure 10:
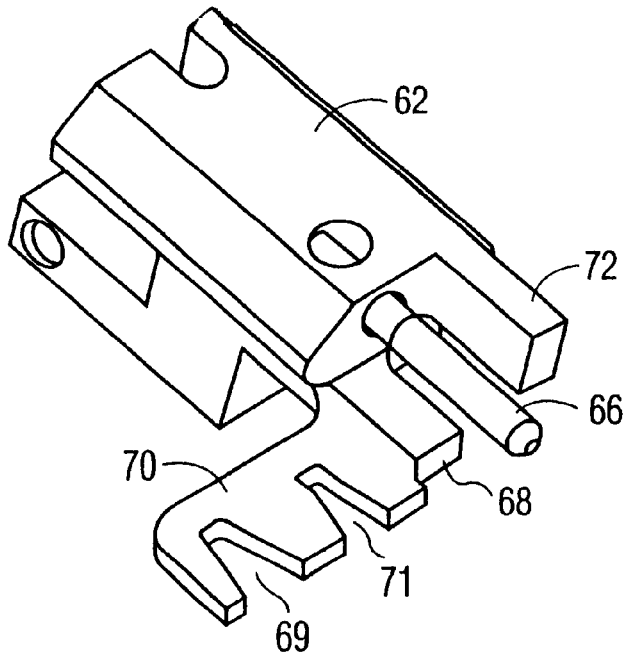
FIG. 10 is a perspective view from a different angle of just the component-separating mechanism.

FIG. 9 is a view from the rear of the pin separator 60. It also shows one way of actuating the pin separator, comprising a pneumatic cylinder (not shown) whose piston is connected to a lever 74 which is moved in the direction shown by the double-ended arrow. The end of the lever 74 forms a wedge cam 76 which drives a follower 78 connected to the block 62. The block 62 is held in position against the wedge cam by friction so that the lateral position of the cam surface 76 controls the lateral position of the block 62. As before, the cylinder is actuated by a suitable controller to function as will be described below in greater detail.

Figure 13:
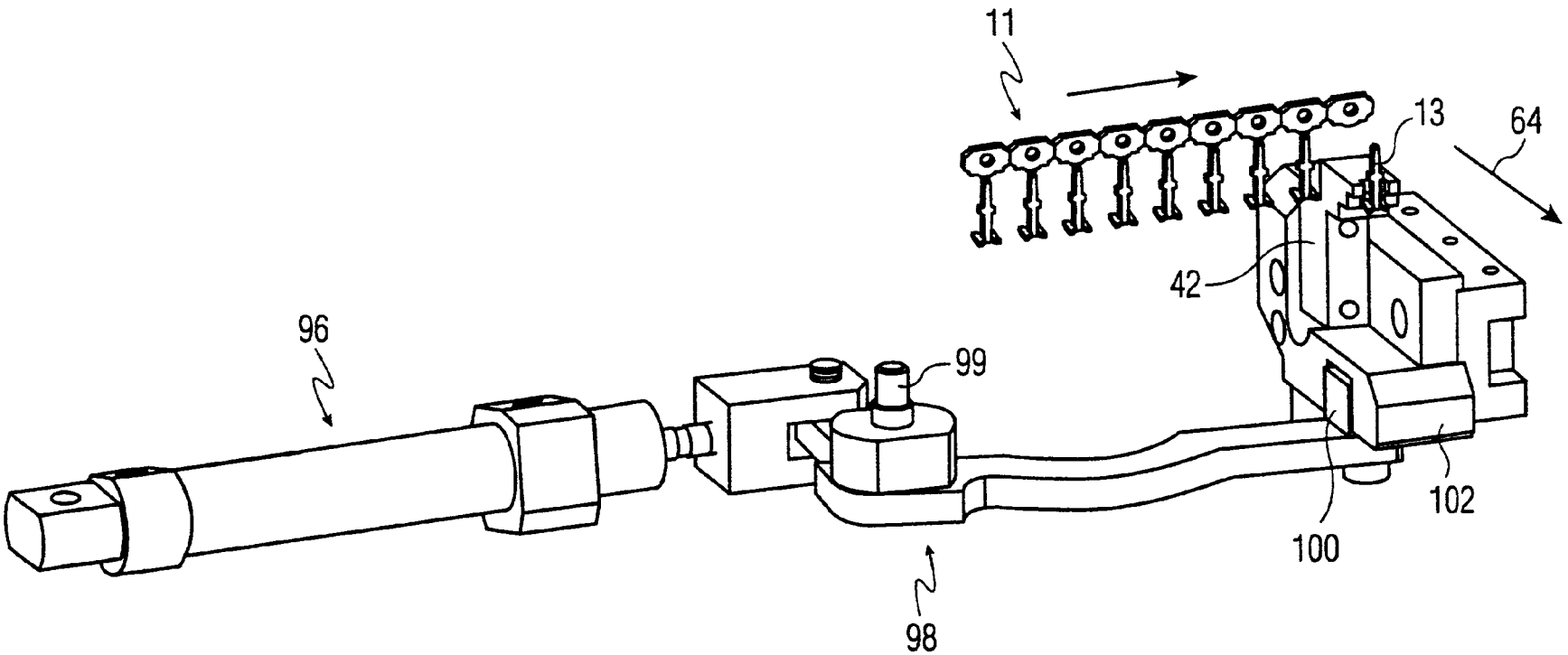
FIG. 13 is a perspective view from the front showing actuation of the component-separating and part of the retaining mechanism.

The separator block 62 cooperates with a block 42 that forms part of the pin retainer 40. The separator block 62 has a descending extension 80 (FIG. 11) forming a pushing surface 82 that is contacts a facing pushing surface 44 of the pin retainer block 42. When the block 62 is advanced toward the pickup location (25 in FIG. 5) shown by the arrow in FIG. 8, it pushes the retainer block in the same direction. Similarly, when, as shown in FIG. 13, the retainer block is moved in the opposite direction (withdrawn), then it pushes the separator block 62 in front of it back to its pre-separation position on the far side of the strip. The retainer block has a clamping surface 46 formed by vertically-spaced V-grooves separated by a recess 47 facing the far side of the strip, the same side as that of the pin separator. The geometry is such that, as the pin separator protrusion 68 acting as a punch engages the far side of the lead pin 13 close to its connection to the carrier, a lower portion of the same lead pin 13 is simultaneously engaged by the V-grooves of the clamping surface 46. At the same time, a pin-retaining lever 84 (FIGS. 8, 12) having a laterally-extending protrusion 86 that is sized to fit into the recess 47 separating the two V-grooves engages with a flat facing surface 48 the opposite side of the lead pin, so that the lead pin is now clamped between the V-grooves of the clamping surface 46 and the surface 48 of the retaining lever 84. The latter is heavily spring-loaded 94 to ensure that the pin when separated is firmly held in the pin retainer. The separation is effected as the two blocks 42, 62 are simultaneously advanced toward pickup location, the spring-loaded lever 84 maintaining the clamping pressure on the retained pin as the combination moves along the path 64. FIG. 12 shows schematically a conventional pneumatic cylinder 92 (shown schematically) whose piston when extended actuates a simple lever system which moves the spring-loaded lever 84 to its unclamping position. It also illustrates the spring 94 which maintains the clamping pressure.

The mechanism so far described moves the pin retainer and separator from its pre-separation positions on the far side of the pin strip to where the separated pin 13 is aligned at the pickup location 25 with the descending axis 26 of the pickup nozzle, on the near side of the pin strip. After the pin has been retrieved by the pickup nozzle, described in more detail below, the assembly must then be moved back to its pre-separation positions on the far side of the pin strip, illustrated in FIG. 8. This is accomplished, in one form, by the extractor linkage shown in FIG. 13. This comprises a pneumatic cylinder 96 whose piston is connected to an L-shaped linkage 98 rotatably mounted on a post 99 and which is slidingly coupled 100 to a mounting 102 for the block 42 of the pin retainer 40. When the pin separator 60 and the pin retainer 40 are advanced toward the pickup location, the linkage 98 simply rotates to a new position. But when the cylinder 96 is activated, the extended piston rotates the linkage CCW pushing the pin retainer and the pin separator to which it is coupled back to their pre-separation positions on the far side of the pin strip.

Figure 14:
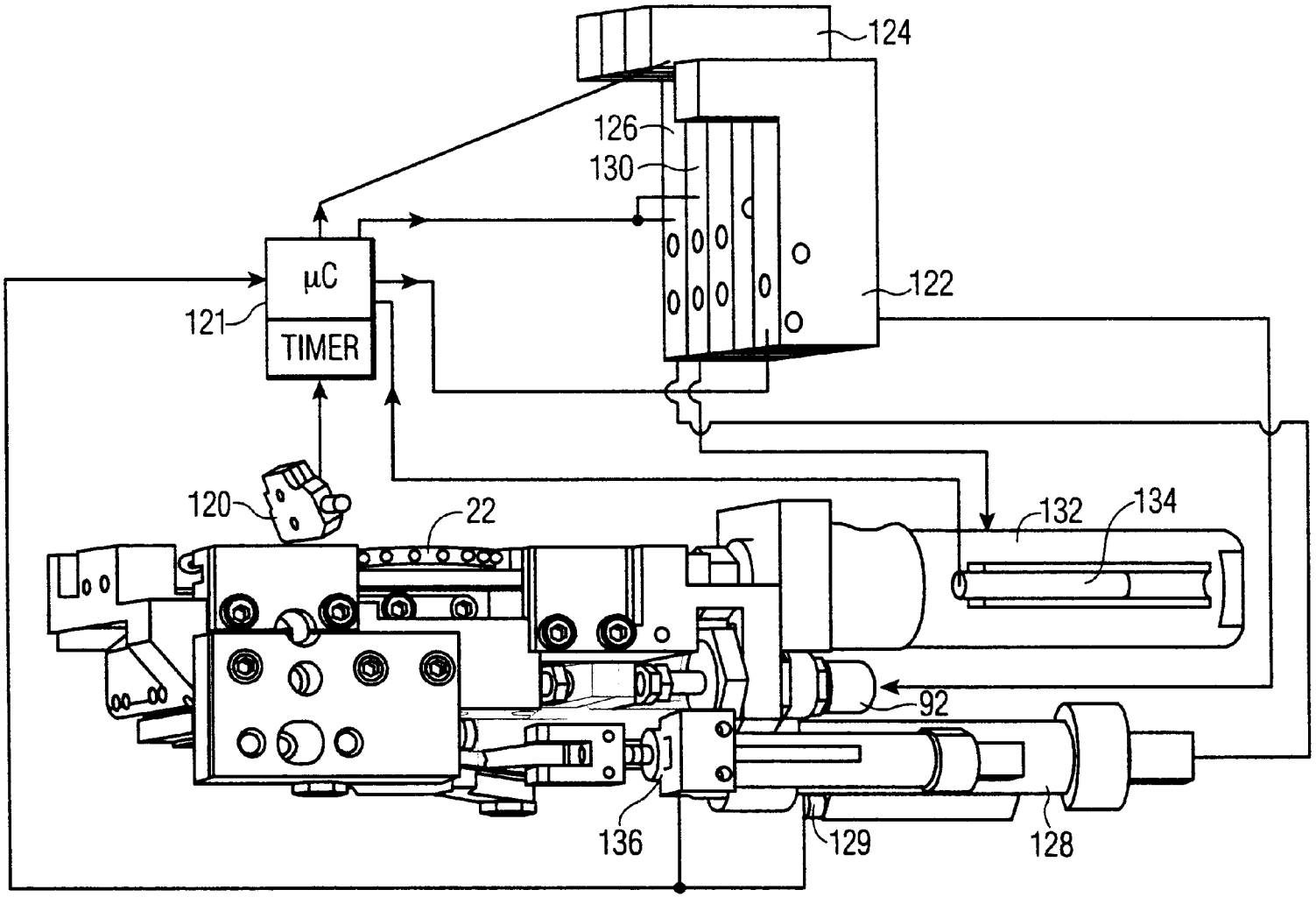
FIG. 14 is a perspective assembly view from the rear with parts invisible from the rear shown separately.

The precise sequence of events to effect this operation is as follows, taken in connection with FIG. 14 which shows several of the parts, actually integral with the feeder, separately for clarity.

As the vacuum pick-up nozzle 104 of the machine descends vertically, when it reaches the pickup location 25 for the purpose of retrieving the pin 13 held by the pin retainer 40, a first electronic sensor 120 integral to the feeder detects the presence of the nozzle and initiates a first release cycle including a preset time delay controlled by a PLC programmable logic controller 121 integral to the feeder so as to release the pin from its holding means when the nozzle has descended an appropriate distance onto the beveled pin end such that it then alone can support the pin.

1. The first event of the release sequence is the energizing of a first solenoid-operated pneumatic valve 122 which pressurizes a first pneumatic cylinder 92 causing the retaining lever 84 to swing away from the pin held in the V-grooves of the retainer block 42 which releases the pin. The pin is now engaged and constrained by the nozzle 104.

2. The next event of the release sequence is the energizing of a second solenoid-operated pneumatic valve 124 which pressurizes a second pneumatic cylinder 96 connected by a mechanical linkage 98 to the V-block portion 42 of the pin holding means, which action causes the V-block 42 to withdraw (withdraw and advance are used with respect to the pickup location) laterally to the pin, in a horizontal direction, and toward the carrier. As the V-block withdraws along the path 64, it pushes the component-separating device 60 which separated the pin from the carrier so that both the V-block 42 and component-separating device 60, after this movement, are clear of the transport path of the pin and the carrier. The final positions of these parts during this step, called herein the pre-separation positions, is with the V-block 42 and the component-separating member 60 adjacent the far (opposite) side plane of the carrier. To avoid possible interference from the carrier or its supported pins, the path 64 extends below the suspended pins 12.

3. As the nozzle 104 rises after thus retrieving the pin 13, the first sensor 120 changes state upon ceasing detection of the nozzle 104 and initiates a pin-separator second cycle which includes a second sequence of events controlled by the PLC to immediately present another pin to the pickup location.

4. The first event in this second sequence is the de-energizing of the first valve 122, causing the retaining lever 84 to return to its starting position adjacent to the near side plane of the strip of pins.

5. The second event in this sequence is the energizing of a third pneumatic valve 126 which pressurizes a third cylinder 128 connected by another mechanical linkage and the ratcheting device 28 attached to the vertical drive shaft 26. A horizontally-disposed wheel, the indexing wheel 22, is fitted with appropriately designed protrusions 24 and affixed to the top end of the vertical drive shaft provides the means to advance the carrier, which are provided with holes 19 for the protrusions, the required predetermined distance to place the next lead pin in position for separation. Typically, the distance is the pin center-to-center spacing.

6. A second electronic sensor 129 detects the completed stroke of this third cylinder 128, causing the energizing of a fourth pneumatic valve 130 which pressurizes a fourth cylinder 132 connected by the single horizontally-disposed wedge shaped link 74 to the rear of the separator block 62. That link 74 via the cam surface 76 causes the aforementioned component-separating device to advance in a direction toward the pickup location, in a horizontal direction laterally to the pin and the plane of the carrier, pushing the empty V-block 42 with it. The component-separating device contains an alignment means 66, previously mentioned, which causes the lead pin 13 still on the carrier to become precisely positioned during this horizontal advancement. The component-separating device also contains the means 72 for breaking off the segment 17 of the carrier to which the previous pin was attached, causing that segment 17 to fall out of the feeder by gravity into a scrap box. With the component-separating device and the V-block moving as a unit, the component-separating device ultimately causes the lead pin 13 to be broken from the carrier and simultaneously positioned in the V-block 42. As the lead pin 13 is breaking from the carrier, it comes into contact with the spring-loaded retaining lever which was following the movements of the V-block, thus clamping the pin against the block clamping surface 46. A third electronic sensor 134 detects the completed stroke of this fourth cylinder 132, causing the de-energizing of the second 124, third 126, and fourth 130 valves and the retraction of the third 128 and fourth 132 cylinders and the extension of the second cylinder 96 which causes the pin-holding means, i.e., the V-block, to position the held pin at the pick-up location 25 described above. Retraction of the third 128 and fourth 132 cylinders resets the respective aforementioned linkages to their normal positions. All actions of the second cycle are now complete and the pin 13 sits in its pin retainer at the pickup location 25 awaiting the arriving vacuum nozzle and the start of the first cycle.

The significant features of this unusual procedure are (a) location of the strip of suspended pins in a plane laterally offset from the pickup location; (b) simultaneous engagement of the pin break-off member and the clamping surface with the far side of the lead pin; (c) lateral movement (advancement) of the component-retaining member with the separated lead pin together with the component-separating member from the offset plane of the strip toward the pickup location; (d) lateral movement (withdrawal) of the component-retaining member without the pin together with the component-separating member from the pickup location toward the offset plane of the strip to retrieve a new pin. This lateral withdrawal movement away from the pickup location after the vacuum nozzle 104 has engaged the pin is to restore the pre-separation positions of the two members, namely, both the component-retaining member 40 and the component-separating member 60 on the far (opposite) side of the carrier facing away from the pickup location, which is necessary to ensure that both the component-retaining member and the component-separating member will be clear of the advancing carrier strip containing the next following pin including the still-left-in-place downstream segment from which the lead pin was separated. Interference is also avoided by the return path extending below the carrier and pins. The PLC controller 121 is programmed so that the carrier is not advanced until after the pre-separating positions are attained as indicated by a fourth electronic sensor 136. The offset position of the strip of suspended pins is necessary because the pin must be released from the carrier supporting it by its beveled end from above to free its beveled end so that it can be engaged by the vacuum nozzle.

In the preferred embodiment, the controller is programmed so that the time delay that occurs between the time that the first cylinder 92 is actuated to swing the spring-loaded lever 84 away from the pin to release it and the time that the V-block starts to withdraw from the pickup location is sufficient so that when the nozzle 104 rises with the captured pin, the pin voyage is not interfered with. For example, the base 15 of the MiniFoot pins extends in several directions so care must be exercised that those extensions do not strike any feeder parts during their ascent. The appropriate timing of these steps avoids that problem, and is easily controlled by the appropriate timing programmed into the controller, as those skilled in this art will readily appreciate. Most commercial controllers allow the user to program numbers representing times into particular registers, and the controller as it executes its program knows to access certain registers to determine the timing of the outputting of control pulses from selected controller outputs connected to the different electronic valves described, which are also available commercially. As previously mentioned, other controllable devices such as electrical solenoids and others can also be substituted for the pneumatic actuating devices described. The use of this programmable controller thus makes it easy to customize the feeder to the particular pick-and-place machine used by the PCB maker.

The electronic sensors employed can be of various known kinds. Preferably, convergent optical sensors are employed which combine an LED as IR beam generator and a phototransistor as the beam detector. The first sensor, which is of this kind, thus has its beam always ON being detected. The arrival of the nozzle interrupts the beam signaling its arrival. When the nozzle departs, the detection of the beam signals its departure. Other kinds of sensors to perform the same functions can easily be substituted for that and the other sensors.

An important feature of the invention is the comb 70 added to the pin-separating block. The pins on the strip can on occasion become bent in the plane of the pin strip. The comb 70 shown in FIG. 10, which is integral with the pin separating device, serves the purpose of straightening pins which may be skewed (bent at the top point where they join the carrier strip) along the direction of travel of the carrier. As the pins advance, the first comb pocket 69 is wider so as to start the straightening process with the angled sides of the teeth, the second pocket 71 is much narrower and further functions to position the pin vertically, and the V block itself serves as the final means to ensure the pin is straight. This process works very well and is capable of straightening pins which are skewed as much as 30 degrees or more to the vertical to provide a high degree of consistent pin positioning.

It will also be understood that the invention is not limited to the specific components shown. Also, different shapes of the components are also considered within the scope of the invention so long as the shape allows for an end for pickup, which can be pointed as in a pin, or flat providing a area surface that allows vacuum pickup.

Where the claims refer to the "first" or "second" paths, this is meant to refer, respectively, to the transport path followed by the strip of components, and the transverse path followed by the component-separating means and component-retaining means.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A feeder for individually dispensing surface-mount components from a strip of carrier-suspended components for pickup by a pick-up member on a pick-and-place machine, the pickup machine causing its pickup member to descend along an axis aligned with a pickup location on the feeder and the pickup member functioning to pickup a component when positioned at the pickup location and carrying the picked-up component upon returning, the feeder comprising:

A) means for feeding the strip of carrier-suspended components along a first path, B) a component-retaining means for temporarily holding at the pickup location a lead component separated from the carrier until pickup by the pickup member, at least part of the component-retaining means being movable along a second path different from and spaced from the first path from a first pickup position at the pickup location to a second pre-separation position that is nearer the first path than the first position, C) a component-separating means for separating the lead component from the carrier while the carrier is in its first path and at least assisting in placing it in the component-retaining means, the component-separating means functioning to separate the lead component from the carrier before the lead component has been moved to the pickup location in alignment with the descending axis of the pick-up member, D) means for sensing the arrival of the pickup member, E) means in response to sensing the arrival of the pickup member for:

(i) releasing a component currently held in the component-retaining means when in its first pickup position allowing the released component to be picked up when the pickup member departs, (ii) moving the movable part of the component-retaining means from its first to its second position when it no longer holds the current component.

2. A feeder for individually dispensing surface-mount components as claimed in claim 1, further comprising:

F) means for sensing the departure of the pickup member,

G) means in response to sensing the departure of the pickup member for advancing the carrier to provide a new lead component.

3. A feeder for individually dispensing surface-mount components as claimed in claim 1, wherein the component-separating means is movable from a first pre-separation position along a path that intersects the position of the lead component when it was still on the carrier to a second position nearer the pickup location, the first path and the second path lying in an imaginary plane that is essentially horizontal.

4. A feeder for individually dispensing surface-mount components as claimed in claim 3, further comprising means for returning the component-retaining means and the component-separating means to their respective second pre-separation position and first pre-separation position, the second pre-separation position and first pre-separation position being adjacent the far side plane of the strip opposite to the side facing the pickup location.

5. A feeder for individually dispensing surface-mount components as claimed in claim 1, wherein the component-separating means comprises means for straightening skewed components while still on the strip.

6. A feeder for individually dispensing surface-mount components as claimed in claim 5, wherein the means for straightening comprises a comb having teeth positioned to intercept and straighten components following the component to be next separated.

7. A feeder for individually dispensing surface-mount components from a strip of carrier-suspended components for pickup by a pick-up member on a pick-and-place machine, the pickup machine sending its pickup member to a pickup location on the feeder and the pickup member carrying a component when returning, the feeder comprising:

A) means for feeding the strip of carrier-suspended components along a first path including means for positioning a lead component while still on the carrier at a separating position, the strip having a first side facing the pickup location and a second side opposite to the first side, B) a component-retaining means for temporarily holding at the pickup location a lead component separated from the carrier until pickup by the pickup member, the component-retaining means being movable along a second path from a first pre-separation position that is nearer the first path to a second pickup position at the pickup location spaced from the first path, said second path extending laterally with respect to the first path, C) a component-separating means for separating the lead component from the carrier and at least assisting in placing it in the component-retaining means, the component-separating means being movable from a first waiting pre-separation position on a second side of the carrier remote from the pickup location along the second path or an extension of the second path that intersects the position of the lead component when still on the carrier at its separation position to a second position on first side of the carrier opposite to the second side, D) means for sensing the arrival of the pickup member, E) means in response to sensing the arrival of the pickup member for:

(i) releasing a component when held in the component-retaining means allowing the released component to be picked up by the arriving pickup member, (ii) when it no longer holds a component, returning the component-retaining means and the component-separating means to their respective pre-separation positions, F) means for sensing the departure of the pickup member, G) means in response to sensing the departure of the pickup member for advancing the carrier along the first path to provide a new lead component at the separating position.

8. A feeder for individually dispensing surface-mount components as claimed in claim 7, further comprising:

H) means in response to sensing the arrival of the pickup member after a time delay for advancing the carrier to provide a new lead component.

9. A feeder for individually dispensing surface-mount components as claimed in claim 8, further comprising:

I) a controller for controlling the operation cycle of the feeder and programmed to perform a first sequence of steps and a second sequence of steps, the first sequence of steps being performed in response to sensing the arrival of the pickup member, the second sequence of steps being performed in response to sensing the departure of the pickup member.

10. A feeder for individually dispensing surface-mount components as claimed in claim 9, wherein the second sequence of steps includes separating the lead component from the carrier, placing it in the component-retaining means, and moving the component-retaining means to its second position at the pickup location.

11. A feeder for individually dispensing surface-mount components as claimed in claim 7, wherein the second path is non-parallel to the first path.

12. A feeder for individually dispensing surface-mount components as claimed in claim 7, wherein the component-separating means comprises a punch surface for contacting the lead pin to be separated from the carrier, the component-retaining means comprises a clamping surface for contacting the lead pin to be separated from the carrier, the geometry of the component-separating means and component-retaining means being such that both the punch and clamping surfaces contact the lead pin at the same time.

13. A feeder for individually dispensing surface-mount components as claimed in claim 12, wherein the component-retaining means further comprises means biasing a retaining member toward the clamping surface such that, when the lead pin is separated, it is captured between the clamping surface and the retaining member.

14. A feeder for individually dispensing surface-mount components as claimed in claim 13, further comprising means for controlling the feeder such that, after the pickup member's arrival has been sensed but before it has departed, the retaining member is pulled away from the clamping surface and the part of the component-retaining means containing the clamping surface has started on its return trip to its pre-separation position.

15. A feeder for individually dispensing surface-mount components as claimed in claim 14, further comprising means for controlling the feeder timing such that the retaining member is pulled away from the clamping surface before the part of the component-retaining means containing the clamping surface has started on its return trip to its pre-separation position.

16. A method of individually dispensing surface-mount components suspended from an overhead carrier to a pick-and-place machine having a pick-up member which arrives at a pickup location by descending along an axis from above the pickup location, picks up a surface-mount component temporarily held by a component-retaining means at the pickup location, and departs from the pickup location with the picked up component, comprising the steps:

A) sensing when the pickup member has departed from the pickup location,

B) in response to sensing that the pickup member has departed from the pickup location, under control of a controller:

(i) moving part of the component-retaining means to a pre-separation position adjacent the carrier and laterally spaced from the descending axis of the pickup member, (ii) advancing the strip of components one component along a transport path to provide a new lead component suspended from the carrier, (iii) then, separating the lead component from the carrier and simultaneously capturing it in the component-retaining means and moving laterally the component-retaining means together with the separated lead component to the pickup location and temporarily holding the separated lead component at the pickup location aligned with the descending axis of the pickup member pending arrival and pickup by the pickup member, C) sensing the arrival at the pickup location of the pickup member, D) in response to sensing the arrival at the pickup location of the pickup member, under control of a controller:

(i) upon engagement by the pickup member of the component, releasing the engaged component at the pickup location allowing the exiting pickup member to carry away the engaged component.

17. A method of individually dispensing surface-mount components suspended from a carrier as claimed in claim 16, wherein the feeder comprises a component-separating means, comprising the further steps:

E) before step B(ii) is carried out, positioning the component-separating means to occupy a pre-separation position on one side of the carrier and positioning the component-retaining means to occupy a pre-separation position on the same side of the carrier, F) during step B(iii), using the component-separating means to break off and separate the lead component from the carrier by moving it laterally, away from its pre-separation position, toward the pickup location, so as to engage the lead component, shear it from the carrier and at least assists in placing it in the component-retaining means, and advancing the component-retaining means together with the separated component toward the pickup location, the component-retaining means stopping at the pickup location and continuing to hold the separated component until arrival and pickup by the pickup member.

18. A method of individually dispensing surface-mount components suspended from a carrier as claimed in claim 16, wherein the feeder comprises a component-separating means, comprising the further steps:

G) during step B(i), returning the component-separating means to its pre-separation position.

19. A method of individually dispensing surface-mount components suspended from a carrier as claimed in claim 16, wherein, during step B(iii), straightening skewed components on the strip upstream of the lead component.

20. A method as claimed in claim 16, comprising the further steps:

E) before step B(ii) is carried out, positioning the component-separating means to occupy a pre-separation position on one side of the carrier and positioning the component-retaining means to occupy a pre-separation a pre-selection position on the same side of the carrier, F) during step B(iii), using the component-separating means to break off and separate the lead component from the carrier by moving it laterally, away from its pre-separation position, toward the pickup location, so as to engage the lead component, shear it from the carrier and at least assists in placing it in the component-retaining means, and advancing the component-retaining means together with the separated component toward the pickup location, the component-retaining means stopping at the pickup location and continuing to hold the separated component until arrival and pickup by the pickup member, while the component-separating means shears off and separates the lead component from the carrier, it also shears off and separates the part of the carrier from which the previous lead component was separated.

21. A method of individually dispensing surface-mount components suspended from a carrier as claimed in claim 18, wherein moving the component-separating means and the component-retaining means in tandem from their pre-separation positions to the pickup location and back.

22. In combination:

a) a pick-and-place machine having a pickup member for moving to a remote pickup location to engage and pickup a component, b) a supply of components suspended from a common carrier, c) the feeder as claimed in claim 1.

23. A feeder for individually dispensing surface-mount components from a strip of carrier-suspended components for pickup by a pick-up member on a pick-and-place machine, the pickup machine sending its pickup member to a pickup location on the feeder and the pickup member carrying a component upon returning, the feeder comprising:

A) means for feeding the strip of carrier-suspended components along a first path, B) a component-retaining means for temporarily holding at the pickup location a lead component separated from the carrier until pickup by the pickup member, at least part of the component-retaining means being movable along a second path different from and spaced from the first path from a first pickup position at the pickup location to a second pre-separation position that is nearer the first path than the first position, C) a component-separating means for separating the lead component from the carrier and at least assisting in placing it in the component-retaining means, D) means for sensing the arrival of the pickup member, E) means in response to sensing the arrival of the pickup member for:

(i) releasing a component currently held in the component-retaining means when in its first pickup position allowing the released component to be picked up when the pickup member departs, (ii) moving the movable part of the component-retaining means from its first to its second position when it no longer holds the current component, F) the component-separating means being movable from a first pre-separation position along a path that intersects the former position of the lead component when it was still on the carrier to a second position nearer the pickup location, G) the first path of the carrier including a portion, near the first pre-separation position of the component-separating means, that extends approximately in a straight line that is non-intersecting with the pickup location.

24. A feeder for individually dispensing surface-mount components from a strip of carrier-suspended components for pickup by a pick-up member on a pick-and-place machine, the pickup machine sending its pickup member to a pickup location on the feeder and the pickup member carrying a component when returning, the feeder comprising:

A) means for feeding the strip of carrier-suspended components along a first path including means for positioning a lead component while still on the carrier at a separating position, the strip having a first side facing the pickup location and a second side opposite to the first side, B) a component-retaining means for temporarily holding at the pickup location a lead component separated from the carrier until pickup by the pickup member, the component-retaining means being movable along a second path from a first pre-separation position that is nearer the first path to a second pickup position at the pickup location spaced from the first path, C) a component-separating means for separating the lead component from the carrier and at least assisting in placing it in the component-retaining means, the component-separating means being movable from a first waiting pre-separation position on a second side of the carrier remote from the pickup location along the second path or an extension of the second path that intersects the position of the lead component when still on the carrier at its separation position to a second position on first side of the carrier opposite to the second side, D) means for sensing the arrival of the pickup member, E) means in response to sensing the arrival of the pickup member for:

(i) releasing a component when held in the component-retaining means allowing the released component to be picked up by the arriving pickup member, (ii) when it no longer holds a component, returning the component-retaining means and the component-separating means to their respective pre-separation positions, F) means for sensing the departure of the pickup member, G) means in response to sensing the departure of the pickup member for advancing the carrier along the first path to provide a new lead component at the separating position, H) the second path being non-parallel to the first path and substantially transverse to the first path.

25. A feeder for individually dispensing surface-mount components from a strip of carrier-suspended components for pickup by a pick-up member on a pick-and-place machine, the pickup machine sending its pickup member to a pickup location on the feeder and the pickup member carrying a component when returning, the feeder comprising:

A) means for feeding the strip of carrier-suspended components along a first path including means for positioning a lead component while still on the carrier at a separating position, the strip having a first side facing the pickup location and a second side opposite to the first side, B) a component-retaining means for temporarily holding at the pickup location a lead component separated from the carrier until pickup by the pickup member, the component-retaining means being movable along a second path from a first pre-separation position that is nearer the first path to a second pickup position at the pickup location spaced from the first path, C) a component-separating means for separating the lead component from the carrier and at least assisting in placing it in the component-retaining means, the component-separating means being movable from a first waiting pre-separation position on a second side of the carrier remote from the pickup location along the second path or an extension of the second path that intersects the position of the lead component when still on the carrier at its separation position to a second position on first side of the carrier opposite to the second side, D) means for sensing the arrival of the pickup member, E) means in response to sensing the arrival of the pickup member for:

(i) releasing a component when held in the component-retaining means allowing the released component to be picked up by the arriving pickup member, (ii) when it no longer holds a component, returning the component-retaining means and the component-separating means to their respective pre-separation positions, F) means for sensing the departure of the pickup member, G) means in response to sensing the departure of the pickup member for advancing the carrier along the first path to provide a new lead component at the separating position, H) the first path extending in a given direction, and the pickup location being laterally spaced, relative to the given direction, with respect to the lead component separating position.

26. A feeder for individually dispensing surface-mount components from a strip of carrier-suspended components for pickup by a pick-up member on a pick-and-place machine, the pickup machine sending its pickup member to a pickup location on the feeder and the pickup member carrying a component when returning, the feeder comprising:

A) means for feeding the strip of carrier-suspended components along a first path including means for positioning a lead component while still on the carrier at a separating position, the strip having a first side facing the pickup location and a second side opposite to the first side, B) a component-retaining means for temporarily holding at the pickup location a lead component separated from the carrier until pickup by the pickup member, the component-retaining means being movable along a second path from a first pre-separation position that is nearer the first path to a second pickup position at the pickup location spaced from the first path, C) a component-separating means for separating the lead component from the carrier and at least assisting in placing it in the component-retaining means, the component-separating means being movable from a first waiting pre-separation position on a second side of the carrier remote from the pickup location along the second path or an extension of the second path that intersects the position of the lead component when still on the carrier at its separation position to a second position on first side of the carrier opposite to the second side, the component-separating means comprising means for straightening any skewed components while still on the strip, D) means for sensing the arrival of the pickup member, E) means in response to sensing the arrival of the pickup member for:

(i) releasing a component when held in the component-retaining means allowing the released component to be picked up by the arriving pickup member, (ii) when it no longer holds a component, returning the component-retaining means and the component-separating means to their respective pre-separation positions, F) means for sensing the departure of the pickup member, G) means in response to sensing the departure of the pickup member for advancing the carrier along the first path to provide a new lead component at the separating position.

27. A method of individually dispensing surface-mount components suspended from a carrier to a pick-and-place machine having a pick-up member which arrives at a pickup location, picks up a surface-mount component temporarily held by a component-retaining means at the pickup location, and departs from the pickup location with the picked up component, the feeder comprising a component-separating means, comprising the steps:

A) sensing when the pickup member has departed from the pickup location,

B) in response to sensing that the pickup member has departed from the pickup location, under control of a controller:

(i) moving part of the component-retaining means to a pre-separation position adjacent the carrier, (ii) advancing the strip of components one component along a transport path to provide a new lead component suspended from the carrier, (iii) then, separating the lead component from the carrier and simultaneously capturing it in the component-retaining means and moving laterally the component-retaining means together with the separated lead component to the pickup location and temporarily holding the separated lead component at the pickup location pending arrival and pickup by the pickup member, C) sensing the arrival at the pickup location of the pickup member, D) in response to sensing the arrival at the pickup location of the pickup member, under control of a controller:

(i) upon engagement by the pickup member of the component, releasing the engaged component at the pickup location allowing the exiting pickup member to carry away the engaged component.

* * * * *